US010470490B2

(12) United States Patent
Karakane et al.

(10) Patent No.: US 10,470,490 B2
(45) Date of Patent: Nov. 12, 2019

(54) CIGARETTE FILTER TOW BAND

(71) Applicant: DAICEL CORPORATION, Osaka-shi, Osaka (JP)

(72) Inventors: Hiroki Karakane, Himeji (JP); Kazuma Oguni, Himeji (JP)

(73) Assignee: DAICEL CORPORATION, Osaka-Shi (JP)

( * ) Notice: Subject to any disclaimer, the term of this patent is extended or adjusted under 35 U.S.C. 154(b) by 186 days.

(21) Appl. No.: 15/120,916

(22) PCT Filed: Jun. 19, 2014

(86) PCT No.: PCT/JP2014/066281

§ 371 (c)(1),
(2) Date: Aug. 23, 2016

(87) PCT Pub. No.: WO2015/194007

PCT Pub. Date: Dec. 23, 2015

(65) Prior Publication Data

US 2017/0099871 A1 Apr. 13, 2017

(51) Int. Cl.

| | |
|---|---|
| ***A24D 3/06*** | (2006.01) |
| ***A24D 3/14*** | (2006.01) |
| ***A24D 3/02*** | (2006.01) |

(52) U.S. Cl.

CPC ..... *A24D 3/067* (2013.01); *A24D 3/022* (2013.01); *A24D 3/0212* (2013.01); *A24D 3/0229* (2013.01); *A24D 3/14* (2013.01)

(58) Field of Classification Search

USPC ..... 131/331, 341, 346

See application file for complete search history.

(56) References Cited

U.S. PATENT DOCUMENTS

| | | | | |
|---|---|---|---|---|
| 3,452,410 | A * | 7/1969 | Clewlow | A24D 3/0204 264/168 |
| 3,756,253 | A * | 9/1973 | Honda | A24D 3/14 131/343 |
| 4,729,390 | A | 3/1988 | Mumpower, II | |
| 5,225,277 | A | 7/1993 | Takegawa et al. | |

(Continued)

FOREIGN PATENT DOCUMENTS

| | | | |
|---|---|---|---|
| CN | 1132051 | A | 10/1996 |
| CN | 201750709 | U | 2/2011 |

(Continued)

OTHER PUBLICATIONS

Eugenol Material Safety Data Sheet, Sigma-Aldrich, 2018, [online], retrieved from the Internet, [retrieved Dec. 27, 2018], <URL:https://www.sigmaaldrich.com/catalog/product/aldrich/e51791?lang=en&region=US>. (Year: 2018).*

(Continued)

*Primary Examiner* — Dennis R Cordray

(74) *Attorney, Agent, or Firm* — Birch, Stewart, Kolasch & Birch, LLP

(57) ABSTRACT

Provided is a material (cigarette component) that enables the elimination or minimization of illicit cigarette production. Specifically, related is a cigarette filter tow band including a crimped bundle of filaments. The tow band includes a detectable marker for identifying the source of the tow band.

4 Claims, 3 Drawing Sheets

(56) References Cited

U.S. PATENT DOCUMENTS

| | | | | |
|---|---|---|---|---|
| 5,427,852 | A * | 6/1995 | Teufel | A24D 3/068 139/331 |
| 5,618,620 | A | 4/1997 | Takegawa et al. | |
| 5,944,026 | A * | 8/1999 | Kopsch | A24D 3/14 131/291 |
| 6,036,885 | A * | 3/2000 | Krutak, Sr. | C08B 1/003 106/170.1 |
| 2004/0200490 | A1* | 10/2004 | Inagaki | A24D 3/14 131/341 |
| 2005/0227068 | A1 | 10/2005 | Dugan | |
| 2010/0093682 | A1* | 4/2010 | Ishida | A24B 15/30 514/171 |
| 2010/0166934 | A1 | 7/2010 | Caiger et al. | |
| 2010/0294288 | A1 | 11/2010 | Sampson et al. | |
| 2013/0255704 | A1 | 10/2013 | Sampson et al. | |

FOREIGN PATENT DOCUMENTS

| | | | |
|---|---|---|---|
| EP | 1839507 | A1 | 10/2007 |
| GB | 1082402 | A | 9/1967 |
| GB | 2489446 | A | 10/2012 |
| JP | 3-161542 | A | 7/1991 |
| JP | 10-287075 | A | 10/1998 |
| JP | 2008-77260 | A | 4/2008 |
| JP | 2010-505967 | A | 2/2010 |
| JP | 2010-533482 | A | 10/2010 |
| WO | WO 2011-148130 | A1 | 12/2011 |
| WO | WO 2013/026098 | A1 * | 2/2013 |

OTHER PUBLICATIONS

Menthol Safety Data Sheet, Sigma-Aldrich, 2014, [online], retrieved from the Internet, [retrieved Dec. 27, 2018], <URL:https://www.sigmaaldrich.com/catalog/product/sial/m2772?lang=en&region=US>. (Year: 2014).*

Extended European Search Report issued in European Application No. 14895132.0 dated Feb. 16, 2017.

International Search Report, issued in PCT/JP2014/066281, dated Sep. 22, 2014.

European Office Action for European Application No. 14895132.0, dated Nov. 12, 2018.

* cited by examiner

[Fig. 1]
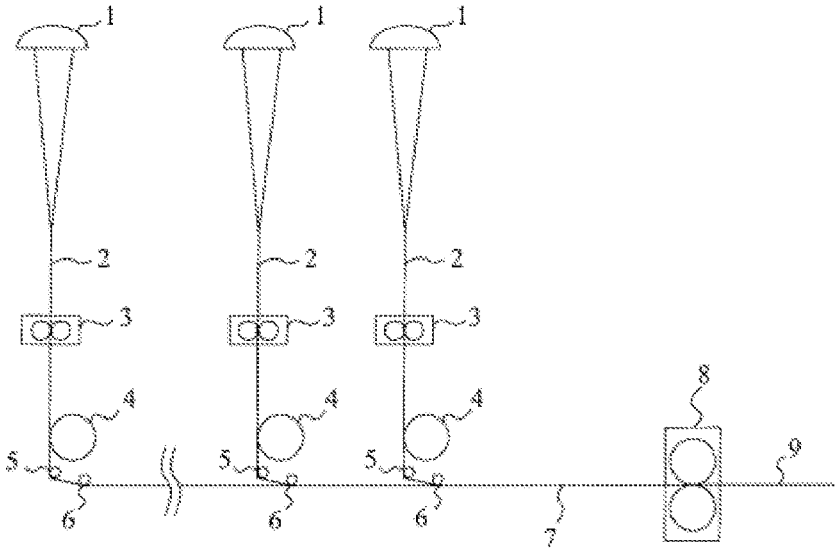
[Fig. 2]
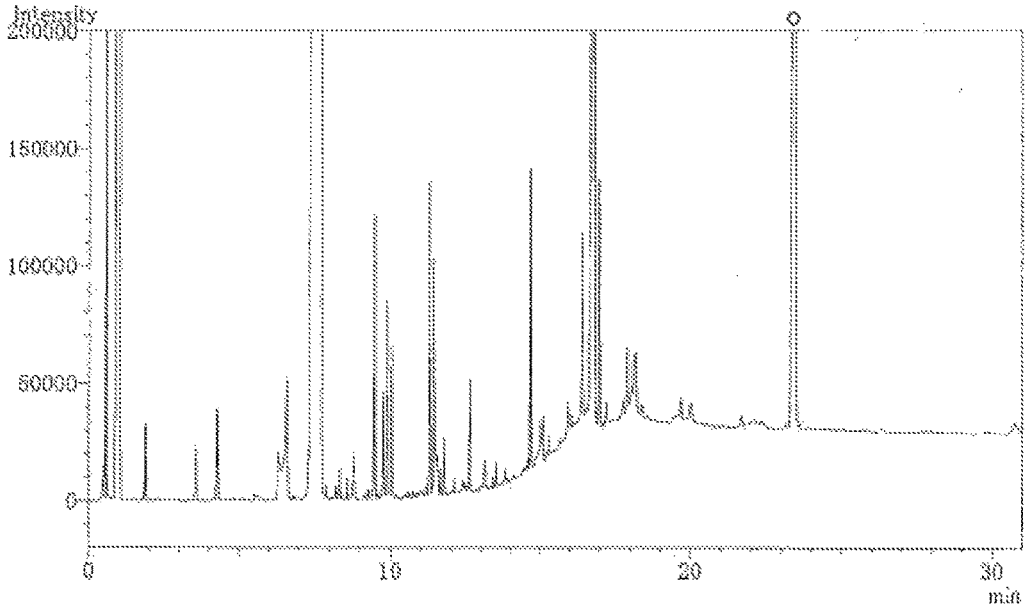

[Fig. 3]
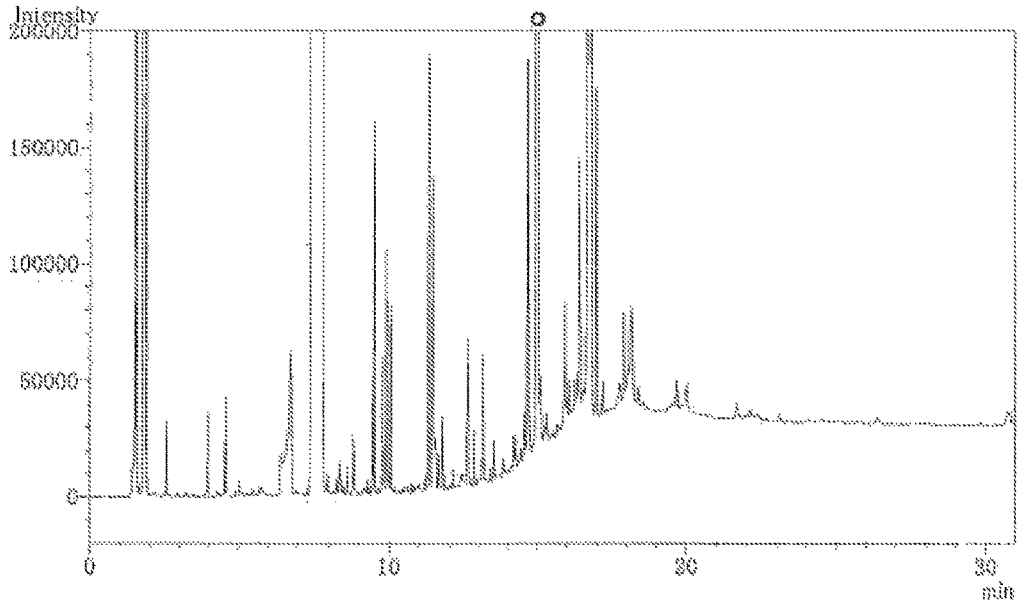
[Fig. 4]
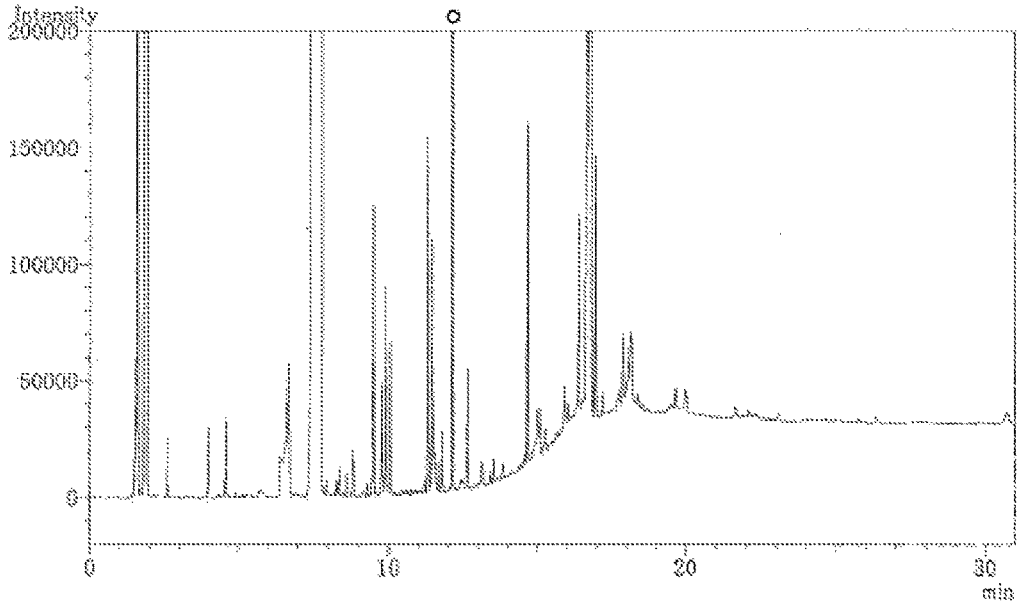

[Fig. 5]
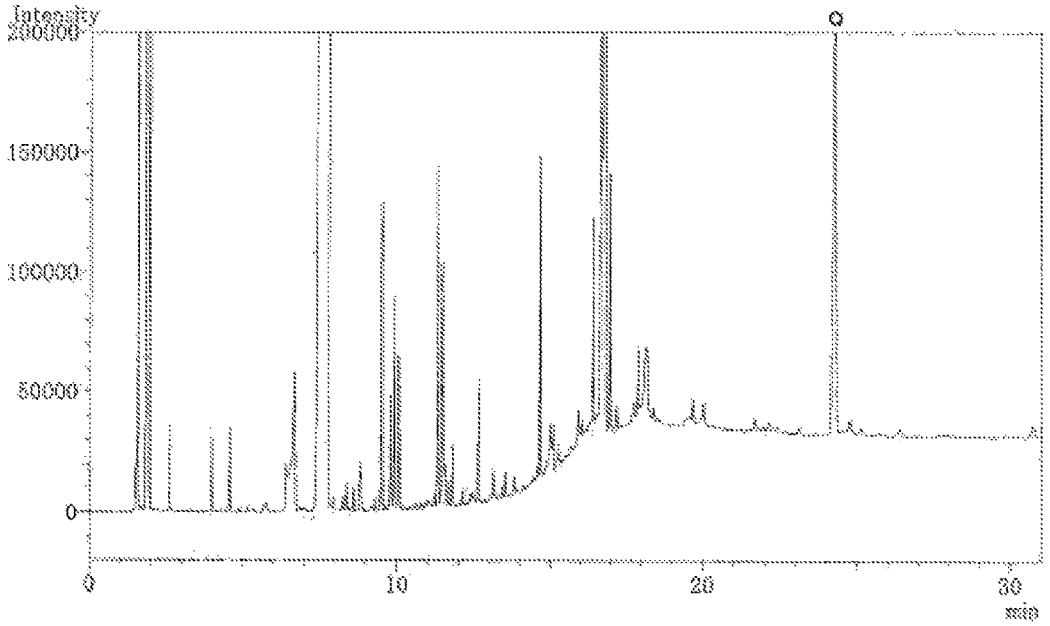
[Fig. 6]
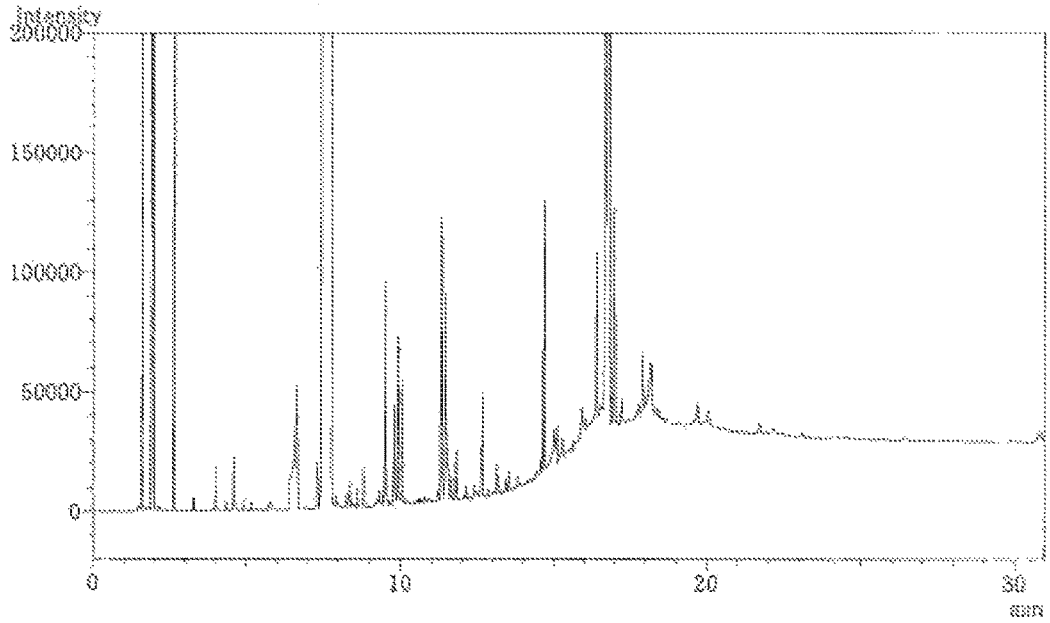

CIGARETTE FILTER TOW BAND

TECHNICAL FIELD

The present invention relates to a tow band (cigarette filter tow band) that is used as a material (component) to constitute cigarette filters. The present invention also relates to a method for identifying the distribution route of a tow band and a method for eliminating or minimizing the production of illicit cigarettes, where the both methods employ the aforementioned tow band.

BACKGROUND ART

Only distribution of cigarettes produced by authorized manufacturers is permitted in various countries. However, flourishing illicit cigarettes have presented problems. The illicit cigarettes are produced by other companies than the authorized manufacturers and are sold as commercial products similar to the authorized cigarettes. This is done for escaping taxation.

SUMMARY OF INVENTION

Technical Problem

The illicit cigarettes cause health hazards on cigarette users due to the use of low-quality raw materials (such as tobacco leaves) and cause reduction in tax revenues. Therefore, it is required to prevent rampancy and widespreading of the illicit cigarettes. However, it is difficult under present circumstances to effectively have a crackdown on the illicit cigarettes as mentioned above. For example, it is difficult to perfectly control tobacco leaves, which are a principal material for cigarettes, because the tobacco leaves themselves are farm products.

Cigarettes themselves are industrial products and are produced using the tobacco leaves in combination with various other materials. Based on this, it is considered that the illicit cigarette production can be prevented by blocking supply of such materials to illicit cigarette manufacturers. However, there is neither an idea nor an effort to achieve the idea under present circumstances, where the idea is of using such a cigarette material to prevent the rampancy of the illicit cigarettes.

Accordingly, the present invention has an object to provide a method for enabling the elimination or minimization of illicit cigarette production and to provide a material (cigarette component) for enabling the elimination or minimization of illicit cigarette production by the method.

Solution to Problem

After intensive investigations to achieve the object, the inventors of the present invention have found followings. Assume that tow bands including markers for identifying the source of the tow bands are distributed to the market as a cigarette filter component (raw material). In this case, when an illicit cigarette including any of the tow bands is found, the source and distribution route of the tow band used in the cigarette filter of the illicit cigarette can be easily identified. Based on the distribution route, the supply of tow bands to the manufacturer and intermediators of the illicit cigarette is stopped. This enables the elimination or minimization of illicit cigarette production. The present invention has been made based on these findings.

Specifically, the present invention provides, in one aspect, a cigarette filter tow band including a crimped bundle of filaments (a plurality of filaments). The tow band includes a detectable marker for identifying the source (origin) of the tow band.

In the cigarette filter tow band, the marker may include one or more compounds, where all the one or more compounds are compounds each having a boiling point of 100° C. or higher at 1 atmospheric pressure.

The compounds in the cigarette filter tow band may include a compound containing, per molecule, one or more aliphatic hydrocarbon groups having a chain length of 6 or more carbon atoms.

In the cigarette filter tow band, the marker may include a combination of two or more different compounds.

The present invention also provides, in another aspect, a method for producing a cigarette filter tow band, where the tow band includes a marker for identifying the source of the tow band. The method includes the steps A, B, C, D, and E as follows. In the step A, filaments are formed. In the step B, the filaments or a tow is loaded with a textile oil. In the step C, the filaments or a tow is loaded with the marker. In the step D, filaments are unified to form the tow. In the step E, the tow is crimped to form the cigarette filter tow band.

At the time of filing of this application, the object of the present invention did not exist (specifically, the idea of eliminating or minimizing the illicit cigarette production using a cigarette component did not exist), and no effort was made to achieve the object. Accordingly, there is no invention that has been known to the public through publication and is related to the present invention, and the citation list information is not provided in the description.

Advantageous Effects of Invention

Assume that the cigarette filter tow band according to the present invention has the configuration is distributed in the market as a cigarette filter component. In this case, when an illicit cigarette including the tow band is found, the source and distribution route of the tow band used in the cigarette filter of the illicit cigarette can be easily identified. Based on the identified distribution route, the supply of the tow band to the manufacturer and intermediators of the illicit cigarette can be blocked. This prevents the illicit cigarette production by the manufacturer of the illicit cigarette and, as a result, may prevent rampancy and widespreading of illicit cigarettes in various countries.

BRIEF DESCRIPTION OF DRAWINGS

FIG. 1 schematically illustrates a representation of an exemplary apparatus for use in the method according to the present invention for producing a cigarette filter tow band;

FIG. 2 is a gas chromatography chart measured in Example 1;

FIG. 3 is a gas chromatography chart measured in Example 2;

FIG. 4 is a gas chromatography chart measured in Example 3;

FIG. 5 is a gas chromatography chart measured in Example 5; and

FIG. 6 is a gas chromatography chart measured in Comparative Example 1.

DESCRIPTION OF EMBODIMENTS

Cigarette Filter Tow Band

The cigarette filter tow band according to the present invention is a tow band including a crimped bundle (bundled assembly) of filaments. The tow band is used as a material to constitute a filter (cigarette filter) of a tobacco (cigarette). Namely, the tow band is a cigarette filter tow band. As used herein, the term "filament" refers to a "single fiber". Namely, the term "filament" refers to a single fiber ejected from a spinning nozzle of a spinning apparatus. As used herein, the term "tow band" refers to a bundle of filaments where the bundle of filaments is crimped, as described above. Specifically, the "tow band" has a total denier and has a number of crimps. Also as used herein, the term "tow" alone refers to a bundle of filaments prior to the unification of the filaments to form a tow band. Namely, the term "tow" refers to an uncrimped bundle of filaments.

The cigarette filter tow band according to the present invention may have a total denier (TD) not limited, but preferably 10000 to 50000, more preferably 15000 to 45000, and furthermore preferably 17000 to 45000. The cigarette filter tow band, when having a total denier of 10000 or more, tends to be more uniformly crimped. In contrast, the cigarette filter tow band, when having a total denier of 50000 or less, tends to allow the cigarette filter to have a pressure drop within an appropriate range. The term "total denier" refers to the number of grams per 9000 m of the tow band and is also referred to typically as "total fineness" or "size of tow band (bundle of tow)". The total denier of the cigarette filter tow band according to the present invention may be controlled typically by the filament denier and number of the filaments to be unified.

The cigarette filter tow band according to the present invention may have crimps in a number not limited, but preferably 30 to 60 per inch, and more preferably 30 to 40 per inch. The cigarette filter tow band, when having crimps in a number of 30 or more per inch, tends to allow the cigarette filter to have still better filter performance. In contrast, the cigarette filter tow band, when having crimps in a number of 60 or less per inch, tends to allow the cigarette filter to have still better mechanical strength. The number of crimps of the cigarette filter tow band according to the present invention may be controlled mainly by the crimping step conditions and other conditions.

The filaments constituting the cigarette filter tow band according to the present invention may be present in a number limited, but preferably 2000 to 100000, more preferably 2500 to 50000, and furthermore preferably 2500 to 30000.

The filaments constituting the cigarette filter tow band according to the present invention may have a filament denier not limited, but preferably 1 to 20, and more preferably 3.0 to 9.0. The filaments, when having a filament denier controlled within the range, tends to allow the cigarette filter to have still better filter performance. The term "filament denier" refers to the number of grams of the filament (single fiber) constituting the tow band per 9000 m of the filament. The "filament denier" is also referred to typically as "single fiber fineness". The filament denier of the filaments constituting the cigarette filter tow band according to the present invention may be controlled typically by filament spinning conditions.

Non-limiting examples of the filaments constituting the cigarette filter tow band according to the present invention include filaments formed by any of known or common spinning techniques such as melt spinning, dry spinning, and wet spinning. A material for the filaments constituting the cigarette filter tow band according to the present invention (namely, a material for the cigarette filter tow band according to the present invention) is not limited and may be selected typically from cellulose esters, native celluloses, regenerated celluloses, and synthetic polymers. Non-limiting examples of the cellulose esters include organic acid esters such as cellulose acetates (e.g., cellulose diacetate and cellulose triacetate), cellulose butyrates, and cellulose propionates; inorganic acid esters such as cellulose nitrates, cellulose sulfates, and cellulose phosphates; mixed acid esters such as cellulose acetate propionates, cellulose acetate butyrates, cellulose acetate phthalates, and cellulose nitrates acetates; and cellulose ester derivatives such as polycaprolactone-grafted cellulose acetates. Non-limiting examples of the native celluloses include native celluloses derived from (prepared from) wood fibers such as pulps of wood such as softwood and hardwood; seed hair fibers such as linters and other raw cotton, Bombax cotton, and kapok; bast fibers typically of hemp, flax, jute, ramie, paper mulberry, and paper bush (mitsumata plant); and leaf fibers typically of Manila hemp (abaca) and New Zealand flax. Examples of the regenerated celluloses include, but are not limited to, viscose rayon, cuprammonium rayon, Fortisan, and nitrate rayon. Non-limiting examples of the synthetic polymers include polyolefins such as polyethylenes and polypropylenes; poly(vinyl alcohol)s; polyesters such as poly(ethylene terephthalate)s; and polyamides. Each of different materials may be used alone or in combination.

In particular, the material for the filaments constituting the cigarette filter tow band according to the present invention (namely, the material to constitute the cigarette filter tow band according to the present invention) is preferably selected from cellulose esters and more preferably selected from cellulose acetates. These are preferred for better smoke flavor of the cigarette. Specifically, the cigarette filter tow band according to the present invention is preferably a cellulose ester tow band and is more preferably a cellulose acetate tow band.

When the cigarette filter tow band according to the present invention is a cellulose acetate tow band, the cellulose acetate constituting the tow band may have a degree of substitution (degree of acetyl substitution) not limited, but preferably 2.0 to 2.6, and more preferably 2.3 to 2.6. The degree of substitution within this range is preferred for the cigarette to have a better smoke flavor and for the cigarette filter to have better performance as a cigarette filter.

The filaments constituting the cigarette filter tow band according to the present invention may have a cross section in any shape not limited and may have a round cross section or a cross section of any other shape, such as elliptic, polygonal, T-shaped, I-shaped, Y-shaped, or X-shaped cross section. The filaments may also have a hollow cross section. In particular, the filaments preferably have a Y-shaped cross section. This is preferred for the filter to have still better performance as a cigarette filter.

The cross-sectional shape and the filament denier of the filaments (e.g., filaments formed by dry spinning) constituting the cigarette filter tow band according to the present invention can be controlled (adjusted) typically by selecting or controlling the shape of the spinneret and other spinning conditions.

The cigarette filter tow band according to the present invention significantly includes a marker for identifying the source (origin) of the tow band, as described above. The marker has to be detectable (e.g., detectable by an aftermentioned analysis technique) from the cigarette filter tow band according to the present invention, or from a cigarette filter made of the tow band. The cigarette filter tow band according to the present invention may include the marker in any form (embodiment) not limited. For example, the tow band may be loaded with the marker on the surface of the tow band. The term "surface of the tow band" also means and includes the surface of the filaments constituting the tow band. The cigarette filter tow band according to the present invention may be loaded with the marker by any procedure not limited. For example, the tow band may be loaded with the marker by treating the surface of the tow band (or of the tow or the filaments) with the marker.

The "marker" in the cigarette filter tow band according to the present invention is a substance for identifying the source of the tow band. More specifically, the marker is a substance acting as a so-called identification code as follows. The cigarette filter tow band according to the present invention or a cigarette filter made from the tow band is analyzed to identify the presence or absence of, and the type (e.g., in terms of chemical composition) of the marker in the cigarette filter. This enables identification of the source (origin) of the tow band. Non-limiting examples of the source information include the product lot of the tow band; the manufacturer and seller of the tow band; purchaser of the tow band; the manufacturer and seller of the cigarette filter made from the tow band; the purchaser, processor, and seller of the cigarette filter; analogues to them (e.g., intermediators); and the distribution route of the tow band or the cigarette filter. The analysis can be performed using a cigarette filter as a sample, where the cigarette filter can be easily sampled from a cigarette distributed as a product in the market. This enables easy identification of the source and distribution route of the tow band. For example, when an illicit cigarette distributed in the market is obtained, the sources and distribution routes of the cigarette filter used in the illicit cigarette, and of the tow band constituting the cigarette filter can be easily identified.

The analysis may be performed using any of known or common analysis techniques such as gas chromatography (GC), liquid chromatography, NMR, mass spectrometry, and ion chromatography, where necessary in combination. For example, the analysis may be performed by sampling a cigarette filter from a cigarette, extracting components in the cigarette filter with a solvent to give an extract, and performing the analysis using the extract as a sample.

The solvent for use in the extraction is not limited and may be selected as appropriate according typically to the materials for the cigarette filter tow band according to the present invention; and type of the marker. Specifically, non-limiting examples of the solvent include water; aliphatic hydrocarbons such as pentane, hexane, and octane; alicyclic hydrocarbons such as cyclohexane and methylcyclohexane; aromatic hydrocarbons such as benzene, toluene, xylenes, and ethylbenzene; halogenated hydrocarbons such as 1,2-dichloroethane; ethers such as diethyl ether, dimethoxyethane, tetrahydrofuran, and dioxane; ketones such as methyl ethyl ketone and methyl isobutyl ketone; esters such as methyl acetate, ethyl acetate, isopropyl acetate, and butyl acetate; amides such as N,N-dimethylformamide and N,N-dimethylacetamide; nitriles such as acetonitrile, propionitrile, and benzonitrile; alcohols such as methanol, ethanol, isopropyl alcohol, and butanol; dimethyl sulfoxide; and any other solvents. Each of different solvents may be used alone or in combination. When the cigarette filter tow band according to the present invention is a cellulose ester tow band (in particular, a cellulose acetate tow band), the solvent is preferably selected typically from aliphatic hydrocarbons and alicyclic hydrocarbons. This is preferred for more efficient extraction of the marker from the cigarette filter or the tow band.

The marker is generally one compound or a composition including two or more compounds. Specifically, the marker may include one compound alone, or a combination of two or more different compounds. In particular for still better traceability, the marker is preferably a composition including a combination of two or more different compounds. In the marker, mainly weighed points are, for example, that the marker is resistant to being taken into the human body during smoking or is harmless; and that the presence in the cigarette filter and the chemical composition of the marker can be can be determined (are detectable). From these viewpoints, the marker for use herein is particularly preferably selected from compounds as described below.

The compounds for use as the marker are preferably, but not limitatively, compounds excluding compounds generally used as emulsifiers or surfactants. The marker, when selected from the compounds as mentioned above, tends to contribute to easier identification of the source and distribution route of the tow band based on the analysis of the cigarette filter tow band according to the present invention or of the cigarette filter made from the tow band.

In particular, the compound(s) for use as the marker is preferably selected from compounds having a boiling point of 100° C. or higher (e.g., 100° C. to 450° C.) at 1 atmospheric pressure; more preferably selected from compounds having a boiling point of 150° C. or higher (e.g., 150° C. to 300° C.) at 1 atmospheric pressure; and furthermore preferably selected from compounds having a boiling point of 200° C. or higher (e.g., 200° C. to 280° C.) at 1 atmospheric pressure. The marker, when selected from compounds having a boiling point of 100° C. or higher at 1 atmospheric pressure, tends to resist volatilization during smoking, to be less taken into the human body, and to less adversely affect the smoke flavor. In contrast, the marker, when selected from compounds having a boiling point of 450° C. or lower at 1 atmospheric pressure, tends to be more easily detected (e.g., detected by gas chromatography) from the cigarette filter tow band according to the present invention, or from the cigarette filter made from the tow band. The compounds may be liquid or solid at room temperature (25° C.)

The compounds for use as the marker may have a molecular weight of preferably 100 to 1000, more preferably 150 to 700, furthermore preferably 200 to 500, and particularly preferably 250 to 450. The marker, when selected from compounds having a molecular weight of 100 or more, tends to resist volatilization during smoking, to be less taken into the human body, and to less adversely affect the smoke flavor. In contrast, the marker, when selected from compounds having a molecular weight of 1000 or less, tends to be more easily detected (e.g., detected by gas chromatography) from the cigarette filter tow band according to the present invention, or from the cigarette filter made from the tow band.

In particular, the marker is preferably selected from compounds having a solubility parameter (SP) of 7 to 11 $(cal/cm^3)^{1/2}$, and more preferably selected from compounds having a solubility parameter of 7.3 to 10.5 $(cal/cm^3)^{1/2}$, where the solubility parameter is determined by the Fedors' method at 25° C. The marker, when selected from compounds having a solubility parameter of 7 to 11 $(cal/cm^3)^{1/2}$, tends to contribute to still better productivity of the tow band, because these compounds have excellent compatibility with the after-mentioned textile oil and can be easily imparted to (loaded onto) the tow band surface as a mixture with the textile oil. The marker in this case also tends to be more easily detected (in particular, detected by gas chromatography). When the marker is a composition including two or more different compounds, the composition as a whole preferably has a solubility parameter within the range, as determined by the Fedors' method at 25° C.

The marker is particularly preferably selected from such compounds that can be easily determined (detected) their presence and can be easily analyzed on their chemical compositions. Specifically, the marker is preferably selected typically from compounds containing one or more aliphatic hydrocarbon groups having a long chain (long-chain aliphatic hydrocarbon groups) per molecule, because these compounds have excellent compatibility with the textile oil, can be easily loaded, and can be more easily detected. The term "long-chain aliphatic hydrocarbon group" refers to an aliphatic hydrocarbon group having a chain length of 6 or more (e.g., 6 to 30) carbon atoms, where the chain length is the length of a chain including carbon-carbon bonds. The long-chain aliphatic hydrocarbon group may for example be an aliphatic hydrocarbon group having a chain length of 8 or more (e.g., 8 to 30) carbon atoms.

The long-chain aliphatic hydrocarbon group may be a straight chain aliphatic hydrocarbon group or a branched chain aliphatic hydrocarbon group. When the long-chain aliphatic hydrocarbon group is a branched chain aliphatic hydrocarbon group, the "chain length" of the group refers to the length of a chain having a largest length (principal chain).

The long-chain aliphatic hydrocarbon group may be a saturated aliphatic hydrocarbon group or an unsaturated aliphatic hydrocarbon group. When the long-chain aliphatic hydrocarbon group is an unsaturated aliphatic hydrocarbon group, the unsaturated group may be a carbon-carbon double bond or a carbon-carbon triple bond. In particular, the unsaturated group is preferably a carbon-carbon double bond. When the long-chain aliphatic hydrocarbon group is an unsaturated aliphatic hydrocarbon group, the number of the unsaturated group (unsaturated bond) is not limited and may be typically from 1 to 10.

The long-chain aliphatic hydrocarbon group is preferably selected from saturated aliphatic hydrocarbon groups, because the resulting compound(s) less deteriorates and can be more easily detected.

The long-chain aliphatic hydrocarbon group may include carbon atoms in a total number (total number of carbon atoms) not limited, as long as being 6 or more, but typically preferably 8 to 40, more preferably 10 to 40, and furthermore preferably 12 to 32.

The compound (compound containing at least one long-chain aliphatic hydrocarbon group) for use as the marker may contain the long-chain aliphatic hydrocarbon group in a number not limited, but typically preferably 1 to 4, and more preferably 1 or 2. The compound may contain each of different long-chain aliphatic hydrocarbon groups alone or in combination.

The marker may also be selected from compounds containing at least one oxygen atom per molecule. The compounds may contain oxygen atom(s) in any form not limited. For example, the compounds may contain oxygen atom(s) typically in the form of having an oxygen-containing group or bond. Non-limiting examples of the oxygen-containing group or bond include hydroxy group, ester bonds, ether bonds (chain ether bonds and cyclic ether bonds), carbonyl group, and carbonate group. The compounds containing at least one oxygen atom (oxygen-containing compounds) may contain each of different oxygen-containing groups or bonds alone or in combination.

More specifically, non-limiting examples of the oxygen-containing compounds include alcohol compounds, phenolic compounds, chain ether compounds, cyclic ether compounds, ester compounds, ketone compounds, carbonate compounds, and carboxylic acid compounds. Among them, the oxygen-containing compounds are preferably the compounds containing at least one long-chain aliphatic hydrocarbon group per molecule. Specifically, the marker is particularly preferably selected from compounds each containing at least one long-chain aliphatic hydrocarbon group and at least one oxygen atom per molecule.

The oxygen-containing compounds may contain oxygen atom(s) in a number not limited, but preferably 1 to 10, more preferably 1 to 5, and furthermore preferably 1 to 3. This is preferred for good compatibility with the textile oil and for easy detection of the marker.

Specifically, non-limiting examples of the compounds for use as the marker include $C_8$-$C_{40}$ straight or branched chain aliphatic hydrocarbons (saturated aliphatic hydrocarbons and unsaturated aliphatic hydrocarbons); compounds represented by Formula (1); compounds represented by Formula (2); compounds represented by Formula (3); and sterols. However, the compounds for use as the marker are not limited to these examples. Formulae (1), (2), and (3) are expressed as follows:

[Chem. 1]

$$R^1(OH)_m \tag{1}$$

[Chem. 2]

$$R^2COOR^3 \tag{2}$$

[Chem. 3]

(3)

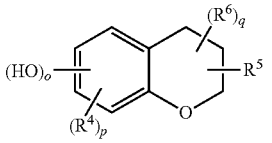

Non-limiting examples of the $C_8$-$C_{40}$ straight or branched chain aliphatic hydrocarbons include aliphatic hydrocarbons (straight or branched chain aliphatic hydrocarbons) containing the long-chain aliphatic hydrocarbon group in a number of 1 or more per molecule.

In Formula (1), $R^1$ represents a $C_8$-$C_{40}$ straight or branched chain aliphatic hydrocarbon group; and m represents an integer of 1 or more. The number m is preferably 1 to 4, and more preferably 1 or 2. The bonding site(s) of the hydroxy group(s) with respect to $R^1$ in Formula (1) is not limited, but is preferably such a bonding site that the long-chain aliphatic hydrocarbon (in particular, an aliphatic hydrocarbon group having a chain length of 8 or more carbon atoms) is present in the molecule.

In Formula (2), $R^2$ represents the long-chain aliphatic hydrocarbon group (monovalent group; in particular, an aliphatic hydrocarbon group having a chain length of 8 or more carbon atoms); and $R^3$ represents a $C_1$-$C_{20}$ hydrocarbon group (monovalent group). Non-limiting examples of $R^3$ include aliphatic hydrocarbon groups, alicyclic hydrocarbon groups, aromatic hydrocarbon groups, and hydrocarbon groups each including two or more of these groups bonded to each other. In particular, $R^3$ is preferably an aliphatic hydrocarbon group and is more preferably a $C_1$-$C_8$ alkyl group.

In Formula (3), n is the number of hydroxy group(s) bonded to the aromatic ring specified in the formula and represents an integer of 1 to 4. The number n is preferably 1 to 3 and more preferably 1 or 2. $R^4$ is a substituent bonded to the aromatic ring specified in the formula and is, independently in each occurrence, selected from a $C_1$-$C_{20}$ hydrocarbon group (monovalent group) and a halogen atom. In particular, $R^4$ is, independently in each occurrence, preferably an aliphatic hydrocarbon group and more preferably a $C_1$-$C_8$ alkyl group. Two or more occurrences of $R^4$, when present, may be identical or different. The number p is the number of the occurrence of $R^4$ bonded to the aromatic ring and represents an integer of 0 to 3. The number p is preferably 1 to 3. $R^5$ represents the long-chain aliphatic hydrocarbon group (monovalent group) and is a group bonded to the tetrahydropyran ring specified in the formula. The bonding site of $R^5$ in the tetrahydropyran ring is not limited. $R^6$ is a substituent bonded to the tetrahydropyran ring specified in the formula and is, independently in each occurrence, selected from a $C_1$-$C_{20}$ hydrocarbon group (monovalent group) and a halogen atom. In particular, $R^6$ is, independently in each occurrence, preferably an aliphatic hydrocarbon group and more preferably a $C_1$-$C_8$ alkyl group. Two or more occurrences of $R^6$, when present, may be identical or different. The number q is the number of the occurrence of $R^6$ bonded to the tetrahydropyran ring specified in the formula and represents an integer of 0 to 5. The number q is preferably 0 to 2.

Examples of the sterols include cholesterol; and phytosterols such as β-sitosterol, campesterol, stigmasterol, and brassicasterol.

The compounds for use as the marker may be available as products commercially available typically as reference materials (standards) for gas chromatography in the form of high-purity products, or mixtures of them.

The compounds for use as the marker may be selected from, but not limited to, compounds excluding the components of the textile oil.

The amount (total amount) (e.g., amount to be loaded) of the marker in the cigarette filter tow band according to the present invention is not limited, as long as being such an amount that the presence and the chemical composition of the marker can be determined from the cigarette filter tow band according to the present invention, or from the cigarette filter made from the tow band, and the source of the tow band can be identified. However, the amount is preferably 0.0002 to 0.2 weight percent, more preferably 0.0015 to 0.3 weight percent, and furthermore preferably 0.002 to 0.5 weight percent, based on the total amount (100 weight percent) of the cigarette filter tow band according to the present invention. The marker, when used in an amount controlled within the range, tends to contribute to more efficient identification of the source of the tow band, without adversely affecting the smoke flavor.

Assume that the cigarette filter tow band according to the present invention is loaded with the after-mentioned textile oil (spinning oil). In this case, the proportion of the marker to the total amount (100 weight percent) of the textile oil and the marker contained in the cigarette filter tow band is not limited, but preferably 0.1 to 10 weight percent, more preferably 0.2 to 5.0 weight percent, and furthermore preferably 0.3 to 3.0 weight percent. The marker, when contained in a proportion controlled within the range, tends to contribute to more efficient identification of the source of the two band without adversely affecting the smoke flavor.

A technique for allowing the marker to be included in the cigarette filter tow band according to the present invention is not limited and may be selected from known or common techniques. The cigarette filter tow band according to the present invention may for example be loaded on its surface with the marker. In this case, the cigarette filter tow band may be prepared by applying the marker as intact to the tow band (or the tow or filaments). Alternatively, the cigarette filter tow band may be prepared by applying a solution or dispersion of the marker to the tow band (or to the tow or filaments). The application may be performed by any of regular surface treatment techniques such as immersion, spraying, and coating. The application may be performed on the surface of the tow (or the tow band or filaments). Specifically, when the marker is soluble in an organic solvent, the tow band may be loaded with the marker typically by preparing a solution of the marker in the organic solvent, and loading (impregnating) the tow band (or the tow or filaments) with the solution. More specifically, assume that the marker is soluble in an alcohol. In this case, the loading with the marker may be performed typically by dissolving the marker in the alcohol to give a solution, and loading the tow band (or the tow or filaments) with the solution according to an appropriate technique (e.g., the surface treatment techniques). The production process for the tow band generally includes the step of drying the textile oil (e.g., textile oil emulsion). The marker in the alcohol solution is secured to the tow band via the drying step.

In particular, the marker is preferably included in the cigarette filter tow band by mixing the marker with the textile oil (e.g., as a textile oil emulsion) and imparting (loading) the mixture containing both the marker and the textile oil onto the surface of the tow band (or the tow or filaments). This contributes to easy control of the loading amount of the marker and prevents increase in complicated steps.

The cigarette filter tow band according to the present invention is not limited, as long as including the marker, but is preferably one loaded on its surface with the textile oil. This is preferred for better properties including spinnability, compactness of the fibrous yarn (tow or tow band), smoothness of the fiber surface (filaments surface, tow surface, and tow band surface), antistatic properties, and antifriction properties.

The textile oil is not limited, may be selected from known or common textile oils, and is exemplified typically by mineral oils and esterified oils. Among them, the textile oil is preferably selected from mineral oils. The textile oil for use in the cigarette filter tow band according to the present invention may include each of different textile oils alone or in combination.

The amount of the textile oil to be loaded onto the cigarette filter tow band according to the present invention is not limited, may be selected as appropriate according typically to the types of the tow band and the textile oil, and the treatment technique, and is generally preferably 0.2 to 2 weight percent, and more preferably 0.6 to 1.5 weight percent, based on the total amount (100 weight percent) of the cigarette filter tow band according to the present invention.

The surface treatment of the cigarette filter tow band according to the present invention with the textile oil may be performed according to a known or common technique without limitation. Specifically, the treatment may be performed by imparting (loading) the textile oil onto the surface of the tow band (or the tow or filaments) by a common surface treatment technique (e.g., immersion, spraying, or coating), using the textile oil as intact, or a solution of the textile oil dissolved in an organic solvent, or an emulsion of the textile oil suspended in water.

When the treatment with the textile oil is performed using the emulsion (textile oil emulsion) of the textile oil suspended in water, the textile oil emulsion may be combined with a surfactant as needed. The surfactant is not limited, may be selected from known or common surfactants, and is exemplified by anionic surfactants and nonionic surfactants. The textile oil emulsion may be further combined with any of known or common emulsifiers and other components.

The textile oil emulsion is preferably selected from textile oil emulsions having a total luminous transmittance of 30% or more with respect to light at 850 nm, as measured at an emulsion concentration of 5 weight percent (see Japanese Unexamined Patent Application Publication No. 2007-77525). The loading of the tow band (or the tow or filaments) with the textile oil emulsion as mentioned above significantly restrains deterioration in quality due to fiber damage by contact wear with apparatuses during the fiber production (formation) step. The loading also significantly restrains deterioration of the working environment due to fiber pieces cut by the wear. In addition, the loading reduces the friction force between spinning guides and the tow band (or the tow or filaments) upon spinning and significantly reduces the frequency of end breakage on godet rollers in the spinning step.

In an embodiment, the cigarette filter tow band according to the present invention is loaded on its surface with both the marker and the textile oil. In this embodiment, the total amount (loading amount) of the marker and the textile oil is not limited, but is preferably 0.2 to 2 weight percent, and more preferably 0.6 to 1.6 weight percent, based on the total amount (100 weight percent) of the cigarette filter tow band according to the present invention. The tow band, if loaded with the marker and the spinning oil in an excessively large total amount, may readily suffer from troubles such as loose tow band and spinning oil dropping in the production process.

The cigarette filter tow band according to the embodiment of the present invention, which is loaded with both the marker and the textile oil, will be described. Upon analysis of the cigarette filter made from the cigarette filter tow band according to this embodiment of the present invention, the cigarette filter is first extracted with an appropriate solvent via extraction typically using a Soxhlet extractor to give an extract. The extract is analyzed by gas chromatography or any other technique. The textile oil is a mixture of two or more substances, has polydispersed molecular weights and polydispersed chemical compositions, and is hardly detected (for example, the textile oil does not offer an apparent peak typically in gas chromatography). In contrast, the marker is a substance(s) having a certain molecular weight and can be easily detected (for example, the marker offers an apparent distinctive peak typically in gas chromatography). It is also considered that the textile oil components are hardly extracted particularly in a tow band (filter) treated with a plasticizer such as glycerol triacetate (triacetin) possibly because the tow band is coated with the plasticizer as a result of the treatment. It has been found that the marker can be easily detected even from a wound-up filter (rod) (for example, the marker offers an apparent peak typically in gas chromatography) in any case.

The cigarette filter tow band according to the present invention may further include one or more other components. Non-limiting examples of the other components include fine inorganic powders such as kaolin, talc, diatomaceous earth, quartz, calcium carbonate, barium sulfate, titanium oxide, and alumina; humectants such as polyols; thermal stabilizers such as salts of alkali metals or alkaline earth metals; colorants; whiteness improvers; yield improvers; sizing agents; biodegradation promoters such as citric acid, tartaric acid, and malic acid; photodegradation promoters such as anatase titanium oxide; naturally-occurring polymers and derivatives thereof, such as cellulose powders; and plasticizers such as triacetin and triethylene glycol diacetate. The cigarette filter tow band according to the present invention may have a structure in which part of the tow band is bonded with a plasticizer. The tow band may include each of different other components alone or in combination.

The cigarette filter tow band according to the present invention is used as a material to constitute cigarette filters in cigarettes. The cigarette filter tow band according to the present invention includes the marker for identifying the source of the tow band, as described above. Assume that the tow band is distributed in the market as a material to constitute cigarette filters (as a cigarette filter tow band). In this case, when an illicit cigarette including the tow band is found, the above-mentioned configuration enables easy identification of the source and distribution route of the tow band used in the cigarette filter of the illicit cigarette. Based on the identified distribution route, the supply of the tow band to the manufacturer and intermediators of the illicit cigarette can be blocked. This enables elimination or minimization of the illicit cigarette production by the illicit cigarette manufacturer. This results in elimination or minimization of rampancy and widespreading of illicit cigarettes in various countries.

Method for Producing Cigarette Filter Tow Band

The cigarette filter tow band according to the present invention may be produced by known or common methods for producing cigarette filter tow bands without limitation. For example, the tow band may be produced typically by a method described below.

The cigarette filter tow band according to the present invention is preferably one loaded with both the marker and the textile oil (one to which both the marker and the textile oil are imparted), as described above. A non-limiting example of the method for producing the cigarette filter tow band according to the present invention to which both the marker and the textile oil are imparted is a method essentially including the steps A, B, C, D, and E as follows.

The step A is the step of forming filaments.

The step B is the step of loading the filaments or a tow with the textile oil.

The step C is the step of loading the filaments or a tow with the marker.

The step D is the step of unifying the filaments to form the tow.

The step E is the step of crimping the tow to form the tow band.

Specifically, the cigarette filter tow band according to the present invention may be produced by the method in which filaments are formed; next, three operations, i.e., the operation of loading the filaments or a tow with the textile oil, the operation of loading the filaments or a tow with the marker, and the operation of unifying the filaments to form the tow are performed in any sequence (two or more operations may be performed simultaneously); and then the tow is crimped to form the tow band. The method may further include one or more other operations (steps).

A spinning technique in the step of forming filaments in the production method is not limited, may be selected as appropriate according to the materials to constitute the tow band, and may be selected from known or common spinning techniques such as melt spinning, dry spinning, and wet spinning. For example, assume that the cigarette filter tow band according to the present invention is a cellulose acetate tow band. In this case, a non-limiting example of the step A is the step of dissolving a cellulose acetate (e.g., a cellulose acetate having a degree of substitution of 2.0 to 2.6) in an organic solvent to give a spinning dope and discharging the spinning dope through spinnerets of a spinning chimney to form cellulose acetate filaments.

In the production method, the step B of loading the filaments or a tow with the textile oil and the step C of loading the filaments or a tow with the marker may be performed simultaneously or sequentially (non-simultaneously). When the step B and the step C are performed sequentially, either step can be performed earlier. In particular, when the step B and the step C are performed sequentially, it is preferred that at least the step B, the step C, and the step E are performed in this sequence, and then the step of drying the resulting tow band is performed. The step B and the step C may be performed in combination with each other. The step D of forming the tow may be performed before or after the step B and may be performed before or after the step C. In the present invention, the step B and the step C are preferably performed simultaneously (particularly preferably in combination); and are preferably performed after the step D and before the step E. Specifically, the steps in the production method are preferably performed in the specified sequence of the step A, the step D, the step B and the step C, and the step E.

FIG. 1 schematically illustrates a representation of an apparatus for use in the method for producing the cigarette filter tow band according to the present invention. The cigarette filter tow band according to the present invention, when being a cellulose ester tow band (in particular, a cellulose acetate tow band), is preferably produced using the apparatus as illustrated.

The apparatus illustrated in FIG. 1 employs two or more spinning chimneys, in each of which a multiplicity of filaments (in particular, cellulose acetate filaments) is spun through a spinneret 1 and bundled to give a tow (in particular, cellulose acetate tow) 2 in a rope form. The two or more tows 2 obtained via the two or more spinning chimneys are bundled into a strap to give a tow (in particular, cellulose acetate tow) 7 as a bundle (bundled assembly) of the tows 2. The tow 7 is subjected to crimping and yields a tow band (in particular, cellulose acetate tow band) 9.

The apparatus illustrated in FIG. 1 includes textile-oil-imparting devices 3, tow-forming devices 6, and a crimper 8. The textile-oil-imparting devices 3 each impart the textile oil and the marker to the tows 2. The tow-forming devices 6 sequentially bundle the tows 2, which are obtained via the two or more spinning chimneys and combined with the textile oil and the marker, into a strap to give the tow 7. The crimper 8 crimps the tow 7, which is formed via the tow-forming device 6. Crimping of the tow 7 by the crimper 8 gives the tow band 9. The apparatus further includes godet rollers 4 and guides 5 so as to smoothly form the tow 7 from the tows 2 combined with the textile oil and the marker. In the embodiment with the apparatus illustrated in FIG. 1, the step B and the step C are performed simultaneously (in particular, performed in combination). Namely, the textile oil and the marker are imparted simultaneously. However, the production method may also employ an apparatus with which the textile oil and the marker are imparted in different positions (different steps).

The textile-oil-imparting devices 3 are not limited, as long as each being a device that can impart the textile oil (e.g., a textile oil emulsion) or a mixture of the textile oil and the marker (e.g., an emulsion of the mixture) to the tows 2, and may be selected from known or common textile-oil-imparting devices (textile-oil-loading devices). Non-limiting examples of the textile-oil-imparting devices 3 include imparting devices of roller, nozzle, slit, and any other systems.

Assume that the textile oil and the marker are imparted at different positions (in different steps). The apparatus may further include marker-imparting devices in addition to the textile-oil-imparting devices 3. The marker-imparting devices are not limited, as long as each being a device that can impart the marker to the tow. For example, the textile-oil-imparting devices 3 can also be used for this purpose. Namely, the textile-oil-imparting devices (textile-oil-loading devices), when using the marker instead of the mixture of the textile oil and the marker, can be used as the marker-imparting devices.

The loading of the marker onto the surface is preferably performed before the crimping step (the step E). This is preferred for uniform loading of the marker onto the surface.

The crimper 8 is not limited and may be selected from known or common crimpers. The crimper 8 imparts sufficient crimping (crimper treatment) to the tow 7, and this gives the tow band 9 (the cigarette filter tow band according to the present invention).

Cigarette Filter and Cigarette

The cigarette filter tow band according to the present invention can be used to produce a cigarette filter. The cigarette filter can be used to produce a cigarette. Methods for producing a cigarette filter using the cigarette filter according to the present invention and for producing a cigarette including the cigarette filter are not limited and may be selected from known or common methods.

Assume that a cigarette uses the cigarette filter made from the cigarette filter tow band according to the present invention. In this case, the cigarette filter constituting the cigarette includes the marker. This configuration enables easy determination (detection) of the presence (or absence) of the marker and the chemical composition of the marker and easy identification of the source and distribution route of the tow band. More specifically, the presence (or absence) and the chemical composition of the marker can be determined by sampling the cigarette filter from a product cigarette, extracting components contained in (loaded onto) the cigarette filter with an appropriate solvent to give an extract, and subjecting the extract to any of the analysis techniques. The solvent for use herein is exemplified as above. For example, assume that the cigarette filter made from the cigarette filter tow band according to the present invention is used in an illicit cigarette. In this case, the source and distribution route of the tow band are identified, based on which supply of the tow band to the manufacturer and/or intermediators of the illicit cigarette is blocked. This prevents the production (further, widespreading and rampancy) of the illicit cigarette, as described above.

The cigarette using the cigarette filter made from the cigarette filter tow band according to the present invention has such a configuration that the marker is loaded onto the cigarette filter portion which is not burnt during smoking and is not exposed to a high temperature (is exposed to a temperature of at highest about 100° C.). Advantageously, not only the cigarette before use, but also the cigarette after use enable identification of the source and distribution route of the tow band using the cigarette filter constituting the cigarette. Conventionally, no one has focused on a constitutional element of cigarettes and on the components of the element, and there has been no technical means to impart a marker to these, in order to prevent rampancy (rifeness) of illicit cigarettes.

Method for Identifying Tow Band Distribution Route and Method for Eliminating or Minimizing Illicit Cigarette Production The cigarette filter tow band according to the present invention, when distributed in the market, enables easy identification of the source and distribution route of the tow band. This is because the cigarette filter tow band according to the present invention includes the marker (detectable marker) for the identification of the source. In addition, assume that a cigarette filter made from the cigarette filter tow band according to the present invention is used as an element to constitute an illicit cigarette. In this case, the source and distribution route of the tow band are identified, and the supply of the tow band to the manufacturer and/or intermediators of the illicit cigarette is blocked based on the identified source and distribution route. This enables elimination or minimization of the production (further, widespreading and rampancy) of the illicit cigarette, as described above. Thus, the present invention also provides a method for identifying the source and distribution route of a cigarette filter tow band and a method for eliminating or minimizing illicit cigarette production. The source and distribution route are also generically referred to as a "distribution route".

The method for identifying the distribution route of a cigarette filter tow band is also referred to as a "method according to the present invention for identifying the distribution route of a cigarette filter tow band". Specifically, the method includes the steps of distributing tow band including a marker for source identification (the cigarette filter tow band according to the present invention) as a cigarette filter tow band; analyzing a cigarette filter on the cigarette filter made from the tow band, or on a cigarette including the cigarette filter, to identify the type of the marker; and identifying the distribution route of the tow band based on the identified marker type. Specifically, by the method according to the present invention for identifying the distribution route of a tow band, the tow band including the marker for source identification is distributed as a cigarette filter tow band; a cigarette filter is analyzed on the cigarette filter made from the tow band, or on a cigarette including the cigarette filter to identify the marker type; and the distribution route of the tow band is identified based on the identified marker type.

In the method according to the present invention for identifying the distribution route of a tow band, a process for analyzing the type of the marker in the cigarette filter in is not limited and may be selected from known or common processes. A non-limiting example of the process is a process by which the cigarette filter is isolated from the cigarette, a loaded component or components are extracted from the filter (e.g., extracted via extraction using a Soxhlet extractor), and the components are analyzed using a known or common analyzing procedure such as gas chromatography, as described above. A technique for identifying the source and/or distribution route of the cigarette filter tow band in the method according to the present invention for identifying the distribution route of a tow band is not limited and may be selected from regular investigation techniques.

The method for eliminating or minimizing the production (further, widespreading and rampancy) of an illicit cigarette is also referred to as a "method according to the present invention for eliminating or minimizing illicit cigarette production". The method includes the steps of distributing a tow band including a marker for source identification (the cigarette filter tow band according to the present invention) as a cigarette filter tow band; analyzing a cigarette filter on an illicit cigarette including the cigarette filter made from the tow band to identify the type of the marker; identifying the distribution route of the tow band based on the marker type identified by the analysis; and blocking the supply of the tow band to the manufacturer and/or intermediators of the illicit cigarette, based on the identified distribution route. Namely, by the method according to the present invention for eliminating or minimizing illicit cigarette production, the tow band including a marker for source identification is distributed as a cigarette filter tow band; a cigarette filter is analyzed on an illicit cigarette including the cigarette filter made from the tow band to identify the type of the marker; the distribution route of the tow band is identified based on the marker type identified by the analysis; and the supply of the tow band to the manufacturer and/or intermediators of the illicit cigarette is blocked based on the identified distribution route.

The method according to the present invention for eliminating or minimizing illicit cigarette production may employ a technique for blocking the supply of the cigarette filter tow band to the manufacturer and/or intermediators of the illicit cigarette, where the technique is not limited and may be selected from common techniques such as business suspension and warning.

EXAMPLES

The present invention will be illustrated in further detail with reference to several examples below. It should be noted, however, that the examples are by no means intended to limit the scope of the present invention.

In the examples below, a marker was added to a textile oil (spinning oil) to give a mixture, a textile oil emulsion was prepared from the mixture, and a cigarette filter tow band was produced using the textile oil emulsion. However, a method for producing a cigarette filter tow band according to the present invention is not limited to this method, and may be, for example, a method in which the tow band (or the tow or filaments) is loaded with the textile oil and with the marker separately.

Production Example 1

Marker

A marker used herein was a GC reference material (±)-α-tocopherol (product code: 207-01792, supplied by Wako Pure Chemical Industries, Ltd.). This is also simply referred to as "tocopherol". The marker had a molecular formula of $C_{29}H_{50}O_2$ and a molecular weight of 430.71.

Textile Oil

A textile oil used herein was one available under the product code of DC-18 (supplied by Matsumoto Yushi-Seiyaku Co., Ltd.). This textile oil had a phase inversion point of 50 weight percent.

A textile oil containing the marker (marker-containing textile oil) was prepared using the textile oil (DC-18) under conditions below, and a textile oil emulsion was prepared from the marker-containing textile oil under conditions below.

Marker-Containing Textile Oil Preparation

Ten (10) grams of the tocopherol was placed into, stirred with, and dissolved in 1 kg of the textile oil (DC-18) and yielded the marker-containing textile oil.

Textile Oil Emulsion Preparation

The above-prepared marker-containing textile oil was subjected to steps (1) to (5) as follows and yielded the textile oil emulsion.

In the step (1), the marker-containing textile oil was subjected to temperature conditioning in a thermostat at 35° C. for 72 hours to control the temperature of the marker-containing textile oil to 35° C.

In the step (2), pure water used as a dilution water was subjected to temperature conditioning in a warm-water tank to control the temperature of the dilution water to 35° C.

In the step (3), 40 kg of the marker-containing textile oil temperature-controlled at 35° C. in the above step were weighed in a 100-L mixing tank equipped with a temperature controller, and the target temperature to be controlled was set at 35° C. Next, the dilution water (water) temperature-controlled at 35° C. using the warm-water tank was charged into the mixing tank at a rate of 5.2 kg/min (at a charging rate of 0.13 kg/min per kilogram of the material textile oil (DC-18)) with stirring.

In the step (4), the charging and stirring of the dilution water was finished at the time point when the amount of the charged dilution water reached 60 L (at the time point when the emulsion concentration reached 40 weight percent), and a textile oil emulsion was obtained.

In the step (5), the textile oil emulsion obtained in the step (4) was further diluted to an emulsion concentration of 5 weight percent and was used in the examples.

Example 1

Spinning Step

Spinning was performed according to a procedure as follows, using the textile oil emulsion prepared in Production Example 1.

Specifically, dry spinning (solvent spinning) was performed, in which a cellulose acetate having a degree of acetyl substitution of 2.5 was dissolved in acetone, heated to 50° C., filtered to give a spinning dope, and the spinning dope was discharged (ejected) through spinnerets, followed by evaporation of acetone by latent heat of the dope and sensible heat of hot air. In the step of dry spinning, cellulose acetate filaments were initially formed, and a multiplicity of the cellulose acetate filaments was bundled to form a cellulose acetate tow in a rope form. The textile oil emulsion prepared in Production Example 1 was imparted to the tow under the spinning chimneys. The cellulose acetate tow prepared in the above manner was a fibrous yarn of acetate fiber tow (cellulose acetate tow) having a total denier of 35000 deniers and including acetate fibers (cellulose acetate filaments) having a filament denier of 3.0 and having a Y-shaped cross section. The amount of the textile oil emulsion to be loaded onto the fibrous yarn was adjusted so that the amount of the textile oil was 1 weight percent relative to the fiber weight. A textile oil emulsion loading device used herein was a roller oiling device. The spinning was performed at a spinning rate of 300 m/min using 17 spinning chimneys.

The cellulose acetate tow, after being impregnated with the textile oil emulsion as described above, was subjected to crimping (crimper treatment), dried, and yielded a cellulose acetate tow band. In addition, the prepared tow band was packed in a box, subjected to pressed bale making, and yielded a bale of cigarette filter tow band.

Filter-Making Step

The bale of cigarette filter tow band prepared in the spinning step was spread to give a cigarette filter. Specifically, the bale of cigarette filter tow band was spread to a width of about 20 cm using a filter rod maker for cigarette smoke filter making (AF2/KDF2 supplied by Hauni AG, Germany). The spread tow band was uniformly sprayed with triacetin as a plasticizer using a plasticizer-adding device. Next, the tow band was fed to a paper rolling machine, rolled up with a web paper at a roll-up rate of 400 m/min into a filter rod, and the filter rod was cut to a length of 120 mm using a cutter. This was further cut to a length of 20 mm and yielded a cigarette smoke filter sample (cigarette filter).

Marker Analysis

The web paper was removed from the cigarette filter portions (cigarette filters) prepared in the above manner, and cellulose acetate filter portions were collected in an amount of about 3 g. This was placed in a 150-ml Soxhlet extractor and was extracted with toluene at 150° C. under reflux for 2 hours to give an extraction liquid. The liquid was subjected to evaporative drying on a rotary evaporator and yielded an extract.

The resulting extract was diluted twofold with chloroform to give a solution, and the solution was injected into a gas chromatographic analyzer under following conditions and was analyzed.

Gas Chromatographic Conditions

Analyzer: GC-1700 supplied by Shimadzu Corporation

Detector: FID

Column: Agilent DB-1 having an inner diameter of 0.32 mm, a length of 30 m, and a membrane thickness of 1 μm Column temperature: 100° C., then raised at a rate of 15° C./min up to 340° C., and held at 340° C. for 15 min Vaporizing chamber temperature: 350° C.

Detector temperature: 350° C.

Carrier gas: nitrogen

Column flow rate: 1.5 ml/min

Split ratio: 1 to 50

Injection volume: 1 μl

A peak assigned to the tocopherol (peak at 23.4 min) was clearly observed in the resulting GC chart (see FIG. 2). Thus, it was demonstrated that analysis of the cigarette filter made from the tow band including the tocopherol as a marker enables easy determination that the cigarette filter and the tow band constituting the cigarette filter had been produced by the above process. In FIGS. 2 to 5, peaks assigned to the markers are indicated with open circles.

In contrast, a cigarette filter made from a tow band devoid of the tocopherol failed to give a clear peak assigned to the tocopherol, even when analyzed by the same method as above (see Comparative Example 1).

Example 2

Preparation of a textile oil emulsion, productions of a cigarette filter tow band and a cigarette filter, and analysis (gas chromatographic analysis) of the cigarette filter were performed by procedures similar to those in Production Example 1 and Example 1, except for using, as the marker, octyldodecanol (2-octyldodecanol, product number 464481, supplied by Sigma-Sigma-Aldrich Co. LLC., having a molecular formula of $C_{20}H_{42}O$ and a molecular weight of 298.55).

A peak assigned to octyldodecanol (peak at 14.9 min) was clearly observed in the resulting CG chart (see FIG. 3). Thus, it was demonstrated that analysis of the cigarette filter made from the tow band including octyldodecanol as the marker enables easy determination that the cigarette filter and the tow band constituting the cigarette filter had been produced by the above process.

In contrast, a cigarette filter made from a tow band devoid of octyldodecanol failed to give a clear peak assigned to octyldodecanol, even when analyzed by the same method as above (see Comparative Example 1).

Example 3

Preparation of a textile oil emulsion, productions of a cigarette filter tow band and a cigarette filter, and analysis (gas chromatographic analysis) of the cigarette filter were performed by procedures similar to those in Production Example 1 and Example 1, except for using, as the marker, isopropyl myristate (Isopropyl myristate, product number M0481, supplied by Tokyo Chemical Industry Co., Ltd., having a molecular formula of $C_{17}H_{34}O_2$ and a molecular weight of 270.46).

A peak assigned to isopropyl myristate (peak at 12.1 min) was clearly observed in the resulting CG chart (see FIG. 4). Thus, it was demonstrated that the cigarette filter made from the tow band including isopropyl myristate as the marker enables easy determination that the cigarette filter and the tow band constituting the cigarette filter had been produced by the above process.

In contrast, a cigarette filter made from a tow band devoid of isopropyl myristate failed to give a clear peak assigned to isopropyl myristate, even when analyzed by the same method as above (see Comparative Example 1).

Production Example 2

Marker

A marker used herein was a combination of two different compounds, namely, a marker 1 and a marker 2. The marker 1 was a tocopherol (DL-α-tocopherol, product code: T0251, supplied by Tokyo Chemical Industry Co., Ltd., having a molecular formula of $C_{29}H_{50}O_2$ and a molecular weight of 430.72 (catalog value)). The marker 2 was an octyldodecanol (2-octyldodecanol, product number 464481, supplied by Sigma-Sigma-Aldrich Co. LLC., having a molecular formula of $C_{20}H_{42}O$ and a molecular weight of 298.55).

Marker-Containing Textile Oil Preparation

Ten (10) g of the marker 1 (tocopherol) and 10 g of the marker 2 (octyldodecanol) were placed in, stirred with, and dissolved in 1 kg of the textile oil (DC-18) and yielded a marker-containing textile oil.

Textile Oil Emulsion Preparation

A textile oil emulsion was prepared by a procedure similar to that in Production Example 1, except for using the above-prepared marker-containing textile oil.

Example 4

Productions of a cigarette filter tow band and a cigarette filter, and analysis (gas chromatographic analysis) of the cigarette filter were performed by procedures similar to those in Example 1, except for using the textile oil emulsion prepared in Production Example 2.

Both a peak assigned to the marker 1 (tocopherol) (peak at 23.4 min) and a peak assigned to the marker 2 (octyldodecanol) (peak at 14.9 min) were recognized in the resulting GC chart. Thus, it was demonstrated that analysis of the cigarette filter made from the tow band including the tocopherol and the octyldodecanol both as a marker enables easy determination that the cigarette filter and the tow band constituting the cigarette filter had been produced by the above process.

In contrast, a cigarette filter made from a tow band devoid of tocopherol and octyldodecanol failed to give clear peaks assigned to these compounds even when analyzed by the same method as above (see Comparative Example 1).

Example 5

Preparation of a textile oil emulsion, productions of a cigarette filter tow band and a cigarette filter, and analysis (gas chromatographic analysis) of the cigarette filter were performed by procedures similar to those in Production Example 1 and Example 1, except for using, as the marker, cholesterol (Cholesterol, product number C0318, supplied by Tokyo Chemical Industry Co., Ltd., having a molecular formula of $C_{27}H_{46}O$).

A peak assigned to cholesterol (peak at 24.3 min) was clearly observed in the resulting CG chart (see FIG. 5). Thus, it was demonstrated that the cigarette filter made from the tow band including cholesterol as the marker enables easy determination that the cigarette filter and the tow band constituting the cigarette filter had been produced by the above process.

In contrast, a cigarette filter made from a tow band devoid of cholesterol failed to give a peak assigned to cholesterol even when analyzed by the same method as above (see Comparative Example 1).

Comparative Example 1

Productions of a cigarette filter tow band and a cigarette filter and analysis (gas chromatographic analysis) of the cigarette filter were performed by procedures similar to those in Production Example 1 and Example 1, except for using no marker. The resulting GC chart is presented in FIG. 6.

REFERENCE SIGNS LIST

1 spinneret
2 tow
3 textile-oil-imparting device
4 godet roller
5 guide
6 tow-forming device
7 tow (bundle of tows 2)
8 crimper
9 tow band

INDUSTRIAL APPLICABILITY

The cigarette filter tow band, the method for identifying the distribution route of a cigarette filter tow band using the tow band, and the method for eliminating or minimizing illicit cigarette production using the tow band, each according to the present invention, can efficiently prevent rampancy and widespreading of illicit cigarettes, which present problems in various countries.

The invention claimed is:

1. A cigarette filter tow band comprising:

a crimped bundle of a plurality of filaments; and a detectable marker for identifying a source of the tow band, wherein the marker comprises one or more compounds;

all of the one or more compounds are compounds each having a boiling point of from 100° C. to 450° C. at 1 atmospheric pressure;

the one or more compounds comprise a compound containing, per molecule, one or more straight or branched chain aliphatic hydrocarbon groups each having a chain length of 6 or more carbon atoms; and the marker comprises neither α-tocopherol nor sterols.

2. The cigarette filter tow band according to claim 1, wherein the marker comprises two or more different compounds in combination.

3. A method for producing a cigarette filter tow band, the tow band comprising a crimped bundle of a plurality of filaments; and a marker for identifying a source of the tow band, wherein the cigarette filter tow band is loaded with a textile oil, the marker comprises one or more compounds, and all of the one or more compounds are compounds each having a boiling point of from 100° C. to 450° C. at 1 atmospheric pressure, the method comprising the steps of:

A) forming filaments;

D) unifying a plurality of the filaments to form a tow;

B) loading the filaments or the tow with the textile oil;

C) loading the filaments or the tow with the marker; and

E) crimping the tow to form the cigarette filter tow band.

4. The cigarette filter tow band according to claim 1, wherein the marker comprises at least one selected from the group consisting of a $C_8$-$C_{40}$ straight or branched chain saturated aliphatic hydrocarbon and a $C_8$-$C_{40}$ straight or branched chain unsaturated aliphatic hydrocarbon.

* * * * *